US011370190B2

(12) United States Patent
Schalk

(10) Patent No.: US 11,370,190 B2
(45) Date of Patent: Jun. 28, 2022

(54) APPARATUS FOR THE PRODUCTION OF A THREE-DIMENSIONAL PACKAGING MATERIAL LIKE A CUSHION PRODUCT FROM A SINGLE- OR MULTI-LAYER PAPER STRIP

(71) Applicant: Sprick GmbH Bielefelder Papier-und Wellpappenwerke & Co., Bielefeld (DE)

(72) Inventor: Bastian Schalk, Detmold (DE)

(73) Assignee: Sprick GmbH Bielefelder Papier-und Wellpappenwerke & Co., Bielefeld (DE)

( * ) Notice: Subject to any disclaimer, the term of this patent is extended or adjusted under 35 U.S.C. 154(b) by 286 days.

(21) Appl. No.: 16/678,791

(22) Filed: Nov. 8, 2019

(65) Prior Publication Data

US 2020/0070458 A1 Mar. 5, 2020

Related U.S. Application Data

(63) Continuation of application No. PCT/EP2018/061860, filed on May 8, 2018.

(30) Foreign Application Priority Data

May 8, 2017 (DE) ..... 102017109867.4

(51) Int. Cl.
*B31D 5/00* (2017.01)

(52) U.S. Cl.
CPC ..... *B31D 5/006* (2013.01); *B31D 2205/0058* (2013.01)

(58) Field of Classification Search
CPC ..... B31D 5/00; B31D 5/0043; B31D 5/0047; B31D 5/006; B31D 5/0069; B31D 5/0086; B31D 2205/0058
(Continued)

(56) References Cited

U.S. PATENT DOCUMENTS 5,569,146 A * 10/1996 Simmons ..... B26D 1/08 493/352
6,179,765 B1 * 1/2001 Toth ..... B26D 7/24 493/360

(Continued)

FOREIGN PATENT DOCUMENTS

DE 195 36 367 A1 4/1997
DE 694 00 576 T2 4/1997

(Continued)

OTHER PUBLICATIONS

International Search Report and Written Opinion of the International Search Authority dated Aug. 22, 2018 in International Application No. PCT/EP2018/061884 (English and German languages) (14 pp.).

(Continued)

*Primary Examiner* — Andrew M Tecco
*Assistant Examiner* — Jacob A Smith
(74) *Attorney, Agent, or Firm* — Crowell & Moring LLP

(57) ABSTRACT

An apparatus for the production of a three-dimensional packaging product, such as a cushion product, from a single- or multi-layer paper strip may include a preforming station deforming the paper strip to a three-dimensional packaging product with at least one crumple hollow space extending in the strip direction, and a rotation cutter following the preforming station in the feed direction of the paper strip, which is cutting a preformed paper strip to the desired length of the packaging product from a preformed paper strip. A cutting shaft on which a blade of the rotation cutter is mounted and a counter shaft on which the cutting pad is mounted may be included. A set-on element is mounted to the cutting shaft and/or the counter shaft for enlarging the flushing radial extension of the shaft and forming a flush profile channel wall section, the flushing profile course of the set-on element
(Continued)

extending in the axial direction of the shaft to at least half of the width of the preformed paper strip section.

15 Claims, 18 Drawing Sheets

(58) Field of Classification Search
USPC ..... 493/352
See application file for complete search history.

(56) References Cited

U.S. PATENT DOCUMENTS

| | | | | |
|---|---|---|---|---|
| 6,190,299 | B1 | 2/2001 | Simmons | |
| 6,632,165 | B1 * | 10/2003 | Letourneau | B31D 5/0052 493/464 |
| 6,918,489 | B2 * | 7/2005 | Harding | B31D 5/0047 206/451 |
| 9,676,586 | B2 * | 6/2017 | Cheich | B65H 45/04 |
| 2002/0082152 | A1 * | 6/2002 | Manley | B31D 5/0047 493/464 |
| 2003/0080540 | A1 | 5/2003 | Kinane | |
| 2006/0027065 | A1 * | 2/2006 | Spatafora | B65B 61/02 83/13 |
| 2008/0125300 | A1 * | 5/2008 | Cheich | B65D 83/0805 493/464 |
| 2009/0004448 | A1 | 1/2009 | Tinianov | |
| 2010/0173130 | A1 * | 7/2010 | Hau | B32B 3/02 428/157 |
| 2011/0061986 | A1 * | 3/2011 | Orsini | B31D 5/0043 192/133 |
| 2012/0165172 | A1 * | 6/2012 | Wetsch | B65H 35/008 493/464 |
| 2012/0289392 | A1 * | 11/2012 | Cheich | B31D 5/0047 493/464 |
| 2013/0296154 | A1 * | 11/2013 | Sip | B31D 5/0043 493/464 |
| 2014/0274645 | A1 * | 9/2014 | Wetsch | B65H 45/06 493/360 |
| 2015/0119224 | A1 * | 4/2015 | Orsini | B31D 5/0043 493/464 |
| 2016/0207274 | A1 * | 7/2016 | Schalk | B26F 1/08 |
| 2017/0095991 | A1 * | 4/2017 | Wetsch | B31D 5/0039 |
| 2017/0313016 | A1 * | 11/2017 | Schalk | B26D 7/18 |
| 2020/0086599 | A1 * | 3/2020 | Schalk | B31D 5/0043 |

FOREIGN PATENT DOCUMENTS

| | | | |
|---|---|---|---|
| DE | 697 00 548 | T2 | 4/2000 |
| DE | 101 03 040 | A1 | 11/2001 |
| DE | 697 08 087 | T2 | 8/2002 |
| DE | 694 33 887 | T2 | 7/2005 |
| DE | 698 28 186 | T2 | 12/2005 |
| DE | 10 2012 018 867 | A1 | 3/2014 |
| DE | 10 2012 018 941 | A1 | 3/2014 |
| DE | 10 2012 218 679 | A1 | 4/2014 |
| DE | 10 2013 015 875 | A1 | 3/2015 |
| DE | 10 2014 016 874 | A1 | 5/2016 |
| DE | 10 2016 101 207 | A1 | 8/2016 |
| EP | 0 679 504 | A1 | 11/1995 |
| EP | 0 876 291 | | 11/1998 |
| EP | 1 497 049 | A2 | 1/2005 |
| EP | 1 964 804 | A2 | 9/2008 |
| EP | 2 171 167 | A1 | 4/2010 |
| EP | 2 711 168 | A1 | 3/2014 |
| EP | 2 719 526 | A1 | 4/2014 |
| FR | 2 970 921 | | 8/2012 |
| GB | 2 359 300 | A | 8/2001 |
| GB | 2501260 | A | 10/2013 |
| WO | WO 95/13914 | | 5/1995 |
| WO | WO 97/13097 | | 4/1997 |
| WO | WO 97/27136 | | 7/1997 |
| WO | WO 97/43097 | | 11/1997 |
| WO | WO 99/17923 | | 4/1999 |
| WO | WO 00/21723 | | 4/2000 |
| WO | WO 03/089163 | A2 | 10/2003 |
| WO | WO 2015/039756 | A1 | 3/2015 |
| WO | WO 2016/037764 | A1 | 3/2016 |
| WO | WO 2016/075001 | A1 | 5/2016 |
| WO | WO 2017/165321 | A1 | 9/2017 |
| WO | WO 2018/005902 | A1 | 1/2018 |

OTHER PUBLICATIONS

International Search Report and Written Opinion of the International Search Authority dated Jul. 20, 2018 in International Application No. PCT/EP2018/061848 (English and German languages) (10 pp.).

International Search Report and Written Opinion of the International Search Authority dated Jul. 20, 2018 in International Application No. PCT/EP2018/061860 (English and German languages) (10 pp.).

International Search Report and Written Opinion of the International Search Authority dated Jul. 20, 2018 in International Application No. PCT/EP2018/061685 (English and German languages) (10 pp.).

Office Action dated Feb. 8, 2018 for German Patent Application No. 10 2017 109 829.1, (10 pp.).

Office Action dated Dec. 12, 2017 for German Patent Application No. 10 2017 109 867.4, (10 pp.).

Office Action dated Dec. 5, 2017 for German Patent Application No. 10 2017 109 851.8, (10 pp.).

Office Action dated Nov. 28, 2017 for German Patent Application No. 10 2017 109 842.9, (10 pp.).

* cited by examiner

APPARATUS FOR THE PRODUCTION OF A THREE-DIMENSIONAL PACKAGING MATERIAL LIKE A CUSHION PRODUCT FROM A SINGLE- OR MULTI-LAYER PAPER STRIP

PRIORITY

This application is a continuation application of International PCT Patent Application No. PCT/EP2018/061860 filed on May 8, 2018, entitled "DEVICE FOR PRODUCING A THREE-DIMENSIONAL PACKAGING PRODUCT, SUCH AS A CUSHIONING PRODUCT, FROM A SINGLE-OR MULTI-LAYER PAPER WEB," which claims priority to German Patent Application No. 10 2017 109 867.4 filed on May 8, 2017, the entire contents of both of which are incorporated herein by reference.

TECHNICAL FIELD

The invention relates to an apparatus for the production of a three-dimensional packaging material like a cushion product from a single- or multi-layer paper strip.

BACKGROUND

This cushion production apparatus according to the subject aiming to be improved by the present invention is known from DE 10 2012 018 867 A1. The production apparatus according to the subject has the distinct effect that the paper-forming process being formed by two embossing teeth wheels opposing each other has not to be interrupted in order to cut the desired preformed cushion paper strip sections to length. The two processes of preforming and cutting can be executed without interruption so that the production efficiency can be increased by the known paper cushion production apparatus. Due to the missing stop cut process, also the effort for maintenance for the production apparatus can be reduced significantly.

SUMMARY

The invention relates to an apparatus for the production of a three-dimensional packaging material like a cushion product from a single- or multi-layer paper strip. Such a production apparatus for paper cushion products according to an embodiment includes a preforming station in which the paper strip, being supplied as a Leporello stack source is formed to a three-dimensional packaging material with at least one crumple hollow space extending in the strip direction. Furthermore, the production apparatus according to the subject as well as according to an embodiment has a rotation cutter being positioned upstream of the preforming station and feed direction of the paper strip that cuts a preformed paper strip sectioned to the desired length of the packaging product from the preformed paper strip. For this purpose, the rotation cutter has a cutting shaft on which a blade is mounted that rotates in a circular-shaped orbit. In order to improve the cutting process, the rotation cutter can have a counter shaft, if applicable, on which a cutting pad is mounted rotating particularly synchronized with a cutting knife or the blade continuously so that the blade can engage into the cutting pad during the cutting process.

In detail, the rotation cutter comprises a cutting knife holder being mounted at a cutting shaft. The cutting support opposing the cutting blade also comprises a counter shaft on which a cutting pad is mounted via a holding fixture. On each of the cutting blade shaft and the counter shaft five working discs are provided being arranged displaceably in the transverse direction perpendicular to the feed direction F or regarding the respective shaft in the axial direction so that the working discs of the counter shaft are positioned between the working discs of the cutting blade shaft. The working shafts of the cutting blade shaft have a pair of perforation noses adjacent to the blade serving to place perforations of the paper of the preformed paper strip section in order to fixate the border area of the preformed paper section against unfolding. The working discs comprise starting from one of the perforation noses a linear cutting edge and cutting edge starting from the other perforation nose. Each of the disc edges delimits the passage channel and provides a wider passage channel whose passage channel cross section decreases constantly in the course of the revolution depending on the rotation position. The respective working disc comprises a radial extremum or a radial protrusion or a radial recess serving as a driver for further feeding the cutoff paper strip section being positioned essentially at the circumferential position diametrically opposed to the cutting knife or at the circumferential position diametrically opposed to the cutting pad. The working discs have proven themselves particularly due to the fact that their masses can be reduced with regard to the guidance of the preformed paper strip section to the rotation cutter and passing the same by means of the working discs for the functionality. On the other hand, it was found out that the engaging working discs cause a squashing of the paper strip material, particularly during the rotation point in time of driving through the radial extremums reducing the damping ability of the preformed paper strip section.

It is the object of an embodiment to overcome the disadvantages of prior art particularly to improve an apparatus for the production of a paper cushion product according to the subject in such a way that higher feed velocities through the production apparatus can be reached without increasing the risk of paper jam in the area of the preforming station and the rotation cutter, because particularly the effort for maintenance can be minimized and the costs of investing for the provision of the rotation cutter technology within the production apparatus can be minimized. This objective is solved by the attributes of the claimed embodiments.

According to that, an apparatus for the production of a three-dimensional packaging product like a cushion product from a single- or multi-layer paper strip is provided. The production apparatus comprises a preforming station deforming the paper strip to a three-dimensional packaging product with at least one crumple hollow space extending in the strip direction. Preferably, the preforming station comprises a chute-like folding or rolling unit laterally folding or rolling the paper strip in the transverse direction during its transport feed in the production apparatus so that the longitudinal edges of the paper strip are for example provided via a Leporello stack essentially being folded on top of one another at the center of the paper strip. A deformation station with two carrier rollers are following the folding or rolling unit in the feed direction, the carrier rollers engaging into each other in the deformation area in order to deform the folded or rolled paper strip to the cushion product. This specific cushion product comprises a deformation area essentially extending centrally in the longitudinal direction on which two hollow space crumple zone are following up in the transverse direction, whose lateral end is also forming the end of the cushion product. The production apparatus according to an embodiment needs a paper cushion product being essentially dumbbell-shaped in its cross-section.

According to an embodiment, a rotation cutter is following up the preforming station in the feed direction of the paper strip, cutting the preformed paper strip section to the desired length of the packaging product from the preformed paper strip. The rotation cutter has a cutting shaft or knife shaft on which a blade or a knife, respectively, of the rotation cutter, is mounted. The rotation cutter is provided with a counter shaft being arranged particularly parallel to the cutting knife shaft and being arranged at the same height in the feed direction. A cutting pad is mounted at the counter shaft in which the blade is engaging during the cutting process. Preferably, a circular-shaped orbit being arranged in such a way that it crosses a path of the preformed paper strip section by the rotation cutter in order to realize a cutting process. Also, the cutting pad can follow a circular-shaped orbit and is arranged with regard to the orbit of the cutting knife that a crossing orbit is facilitated for the necessary engagement of the cutting knife with the cutting pad.

According to an embodiment, a set-on element for increasing the area radial extension of the shaft for forming a flush profile channel or section being attached to the cutting shaft and/or the counter shaft whose flush profile course is extending in axial direction of the shaft at least extends half of the width of the preform paper strip section. It was surprisingly found out that compared to the working discs of smaller contact area, a significant improvement of the feed flow of the preformed paper strip sections can be achieved by a rotation cutter, if a flush extension of the area radial setting of the shaft towards the feed path of the preformed paper strip section can be provided instead of the narrow working discs. The flush profile channel section provided by that results in a flush contact with a preformed paper strip section before and after the cutting by the rotation cutter, whereby a uniform encompassing of the paper strip section, a guiding of the paper strip section and a driving as well further feed of the paper strip section can be achieved. In spite of the increased friction surface caused by the increase of the area contact area, it was shown that a chopping engagement of the preform paper strip section is prevented so that paper jams are avoided and lower feed forces are needed in order to assure a feed flow of the paper strip section through the rotation cutter.

By taking the measure according to an embodiment, a profile channel wall section is formed with the shaft being essentially passive at a revolution point in time or in the revolution point in time of the engagement of the cutting knife in the preformed paper strip section, but also engaging fully with the paper strip section when leading the cutting knife of the rotation cutter of the feed path of the paper strip section and taking the same when an elevated profile opposing the cutting pillow or the cutting knife, respectively, is engaging and on the other hand providing essentially a plane channel after the cutting process, particularly at a further revolution by 90°, the plane channel providing the rotation cutter for the next cutting process.

In one embodiment, the set-on element or the flush set-on body is particularly exclusively mounted to the counter shaft.

The flush set-on body receiving the shaft essentially integrally extends the whole width of the preformed paper strip section and particularly beyond that in order to assure a flush contact between the set-on element and the preformed paper strip section. The flush outer profile of the set-on element extends both, at least half of the width of preformed paper strip section and a side opposing in circumferential direction of a side of a holder of the blade and/or the cutting pad of the rotation cutter so that the set-on element of the shaft encompasses the shaft in an encompassing amplitude of at least 270°. The size of the not encompassed area depends on the circumferential width of the holder of the blade and/or of the cutting pad.

The set-on element or the set-on body is flush compared to the working disks arranged in an axial distance to each other in both the axial direction and particularly comprises a continuous, constant, discontinuity-free course of the area in both, axial direction and circumferential direction.

The rotation cutter has at least one counter-balance mass that can be integrated inside the set-on element. In an embodiment, the cutting shaft and/or the counter shaft are provided with a counterbalance mass in such a way that the cutting shaft and/or the counter shaft, preferably the rotation cutter, rotates free of imbalance. The cutting shaft and/or the counter shaft can be designed with components respectively attached to them or it, including a respective radial mass symmetric counterbalance mass. A counterbalance mass can be provided opposing the blade (or the pad) and/or the set-on element.

The set-on body of a development of an embodiment has a longitudinal slot extending particularly completely from a transverse side of a transverse direction to a transverse side in axial direction opposing the same, wherein the longitudinal slot is unvarying in cross-section in the course of the axial direction. The shaft is inserted into the set-on element in the radial direction via the longitudinal slot depending whether the set-on element is set on the cutting shaft and/or on the counter shaft. The longitudinal slot comprises a feature base extending in the axial direction against which the shaft is abutting in the introduced state. The feature base off the longitudinal slot is preferred and in sections formed essentially shaped complementarily to the cylindric shaft so that the shape complementary feature base can abut form-fittingly on the shaft. The shaft does need to be necessarily cylindric, can have springs in sections engaging into the grooves of the feature base or vice-versa. The feature base determines the position of the shaft at least in axial direction. Preferably, the feature base of the longitudinal search comprises at least one or several slots in order to facilitate the connection of the shaft to the set-on body at the inner side. Preferably, a holder for the blade and/or the cutting pad is glued to the shaft for mounting the set-on element to the shaft. The several slots mentioned above can serve to receive a compound material, like a glue.

In order to form the longitudinal slot, the set-on body comprises two gripping arms extending from the shaft in the radial direction and an inserted state, the gripping arms being delimited by the longitudinal set in the circumferential direction, wherein the free axis cross-section of the longitudinal slot stays essentially unchanged by the gripping arms. The gripping arms serve to grip the shaft tightly and in a further pathway also the holder starting from the feature base for the blade and/or for the cutting pad in forming a form-fit. Particularly good results are reached using plastics for the set-on element and using glue.

The radial extension of the gripper is smaller than the radial extension of the cutting pad and/or the blade of the rotation cutter in order to avoid disturbance of the functionality of the rotation cutter. The usage of the set-on element according to an embodiment at the respective shaft can be executed at both the cutting shaft and the counter shaft.

In a development of the embodiments, the set-on element has a flush, particularly in the axial direction and the circumferential direction continuous bent cushion product outer profile being bent three-dimensionally and having no profile irregularities particularly in its course in its direction and circumferential direction. The cushion product outer profile is arranged upstream particularly in revolution circumferential direction of the shaft relatively to the holder mounted at the shaft for the blade and/or for the cutting pad of the rotation cutter. Additionally, or alternatively, the cushion product outer profile comprises at least one profile recess, preferably two profile recesses, having two crumple hole spaces on the outside for the case of dumbbell-shaped cushion products forming a cushion curvature and a central deformation strip at the axial position of at least one crumple hole space of the packaging product so that the profile recess is form-fitted to a cushion curvature formed by the crumple hole space. It shall be clear that the adaption of the profile recess to the cushion curvature is not to be understood in the sense of shape identicality since the cushion curvature of the cushion product is not uniform but rather depends on the deformation of the paper area. Nevertheless, the adaption of the profile recesses is to be understood in the way that the cushion curvature formed by the crumple holder space is not significantly changed when being received in the profile recess, particularly in the way that the cushion product is not irreversibly deformed there.

The at least one profile recess is delimited in axial direction by radial elevations. It shall be clear that the central radial elevation is delimiting the adjacent profile recess. Preferably, two radial elevations on the outside are provided that are limiting the abutting profile recess laterally/axially when forming two profile recesses. The radial elevations are designed in such a way that the cushion curvature is held along the parameter of the cushion product outer profile against backing away axially.

A radial distance of a profile course of the cushion product outer profile along the axial direction of the at least one profile recess and/or the radial elevation, of the entire cushion product outer profile, decreases continuously starting from a holder mounted at the shaft for the blade and/or the cutting pad of the rotation cutter in the circumferential direction, particularly in the revolution direction of the shaft, according to a first circumferential section. According to a second circumferential section of the cushion product outer profile following the first circumferential section in the revolution direction, the radial distance of the profile course of the cushion product outer profile increases. The radial distance of the profile course of the cushion product outer profile merges into a radial top point whose profile in the axial direction is adjusted to the axial profile with the recesses/radial elevations. The radial extension of the radial top point is largest with regard to the entire body of the set-on element. Alternatively, or additionally to that, the radial top point is arranged in a circumferential distance of 180° to 225° from the blade and/or the cutting pad. The radial top point is not to be understood as a physical point but rather as extremum forming an extremum line along the axial direction.

The at least one profile recess extends in the circumferential direction from a holder to a radial top point, wherein the radial distance is changing. The curvature in the axial direction can essentially stay constant, preferably in the course of the circumferential direction of the respective recess.

In the development of the invention, the radial distance of the gripping arms is smaller compared to the radial distance to the radial top point in the area of the radial elevations essentially diametrically opposing the gripping arms, particularly to the gripping arms being arranged in a circumferential distance of about 125° to 225°, and/or being larger in the area of at least one profile recess at the lowest position.

At least one profile recess, particularly mainly along the axial cross-section is formed circular segment-shaped, particularly with a radius of more than 20 mm, preferably between 40 mm and 50 mm. At least one radial elevation, preferably a central radial elevation, with a concave recess whose curvature is particularly smaller than the curvature of the at least one profile recess or is circular-shaped, particularly with a radius of smaller than 20 mm or larger than 5 mm, preferably between 10 mm and 20 mm. The curvatures just indicated relate to a course of the profile recesses in the axial direction.

In one embodiment, the set-on element is a further, plane, even profile next to the cushion product outer profile, namely a channel wall being flush, essentially plane, particularly in its cross-section in the axial direction and in the circumferential direction. It shall be clear that the plane channel outer wall can certainly have smaller deviations being particularly smaller than 5° or 10°. The channel outer wall is arranged downstream of the shaft, preferably in revolution circumferential direction relatively to the holder for the blade and/or the cutting pillow of the rotation cutter being attached to the shaft. The plane channel outer wall can essentially extend plane from a holder of the blade and/or the cutting pad particularly mounted on a shaft to a radial top point already mentioned above. The radial extension of the radial top point particularly depends from the view of the position in the axial direction and is arranged in a largest distance and/or a circumferential distance of 125° to 190° from the blade and/or the cutting pad, relatively to the set-on element.

Furthermore, the plane channel outer wall can continue continuously into the cushion product outer profile, particularly at its circumferential position of the radial top point/the radial top point line of the cushion product outer profile.

In one embodiment, the flush body of the set-on element has an axial extension between 50 mm and 1000 mm, particularly between 100 mm and 200 mm, preferably between 120 mm and 180 mm. Obviously, the flush body can be adapted to other production apparatuses either having larger axial extensions or smaller. However, it shall be clear that the set-on body shall be flush in its outer profile in order to cover at least 50% of the maximal extension of the preformed paper strip section.

In one embodiment, the set-on body is made of a flush body piece, particularly from a plastic piece, for example of polyalactid (PLA), particularly molded or made by additive manufacturing, particularly a 3D printing technology. Preferably, the flush set-on body is rotationally asymmetric regarding its longitudinal axis of the respective shaft and axial symmetric regarding an axis parallel in the feed direction. The just mentioned symmetry particularly relates to the cushion product outer profile of the set-on element.

Furthermore, the set-on element can be a flush hollow body, its outer side being, as described above, profiled and plane. Preferably, the flush hollow piece comprises an inner honeycomb structure, with quadratic combs, particularly identical in shape.

In one embodiment of the invention, the set-on element is set on and mounted, particularly glued, to the counter shaft on which the cutting pad is mounted. The cutting pad runs simultaneously into the feed apparatus in a direction opposite to the revolution directions of the cutting blade of the rotation cutter, wherein the blade interacts with a revolving cutting pad operation accordingly. The set-on element is mounted in such a way that:

in a 12 o'clock position (see attached Figures with top view to the rotation cutter according to the invention, the cutting pad is in a 6 o'clock position when the cutting knife is in the 12 o'clock position, the paper strip section is cut in the 12 o'clock position of the cutting knife) particularly the above-described plane wall profile, namely the channel outer wall, of the flush set-on element is perpendicular to the feed direction of the preformed paper strip section completely passing the rotation cutter, wherein the plane channel outer wall is positioned upstream with regard to the opposing cushion product outer profile of the set-on element;

in a 9 o'clock position (a cutting knife being revolved by 90° after the cutting process; the cutting pad is also in the 9 o'clock position) the channel outer wall forms a channel inner wall extending parallel in the feed direction terminating the clearance in which the counter shaft is arranged;

at a 6 o'clock position of the cutting knife (a position being turned by 180° relatively to the cutting position; the cutting pad is in a 12 o'clock position) the plane channel outer wall is perpendicular to the feed direction and is downstream opposing the cushion product outer profile of the set-on element opposing the plane channel outer wall; and/or in a 3 o'clock position of the cutting knife (being turned by 270° relatively to the cutting position, the cutting pad is also in a 3 o'clock position) the cushion product outer profile of the set-on element is facing the feed path of the preformed paper strip while the plane channel outer wall (passive) is averted outwards to the feed strip.

BRIEF DESCRIPTION OF THE DRAWINGS

The system and method may be better understood with reference to the following drawings and description. Non-limiting and non-exhaustive embodiments are described with reference to the following drawings. The components in the drawings are not necessarily to scale, emphasis instead being placed upon illustrating the principles of the invention. In the drawings, like referenced numerals designate corresponding parts throughout the different views.

DETAILED DESCRIPTION

Figure 1:
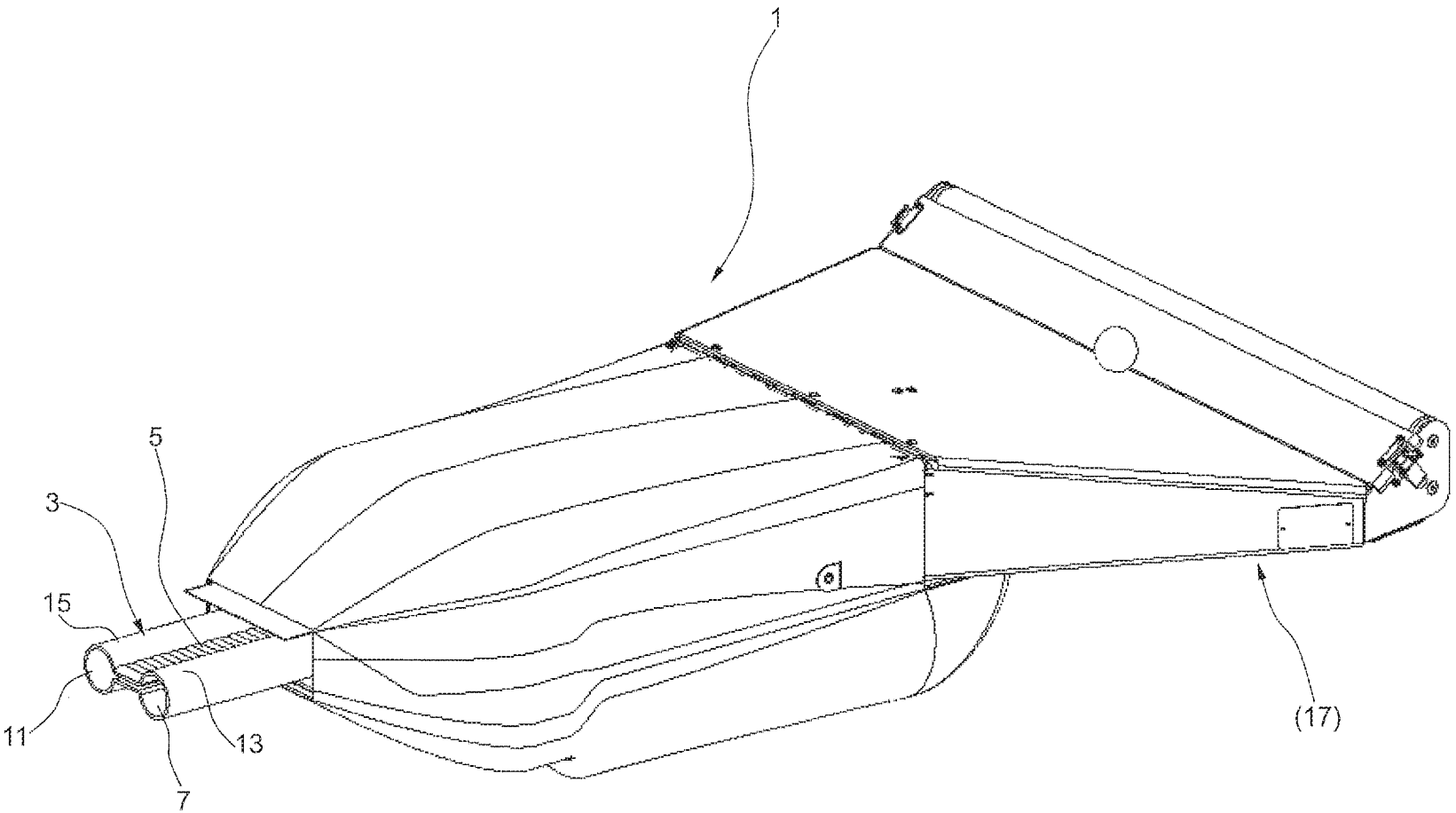
FIG. 1 is a perspective view from outside to an apparatus according to the invention for the production of a three-dimensional packaging product form a single- or multi-layer paper strip, namely a cushion product, wherein the apparatus is denoted with reference numeral 1 and the cushion product with the reference numeral 3.
Figure 2A:
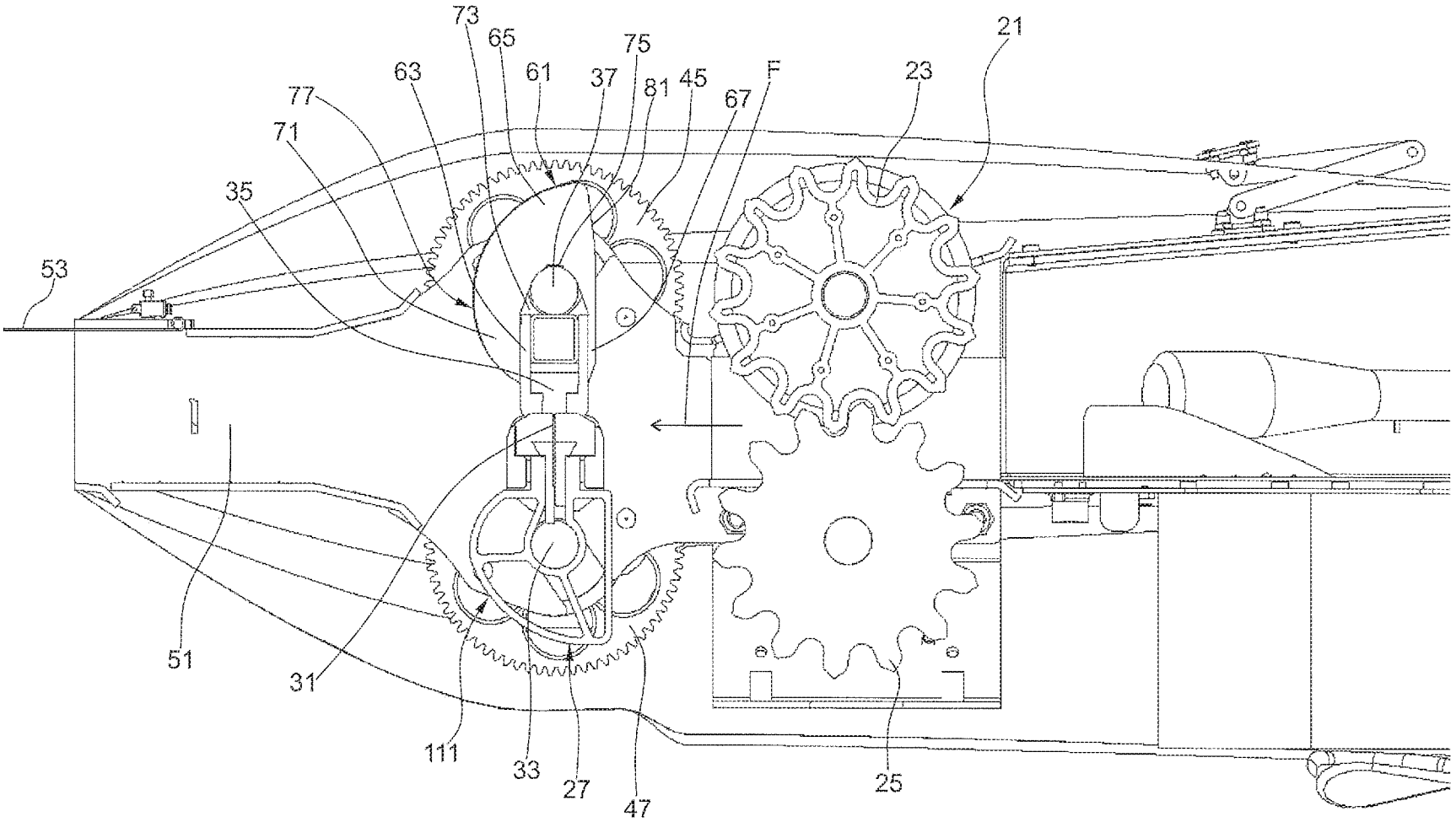
FIG. 2*a-h* is a lateral cross-sectional view to the production apparatus for the unambiguous representation of the deformation station 21 and the rotation cutter 27 wherein different operation situations of the rotation cutter 27 and the course of the revolution motion of the rotation cutter before the actual cut (FIG. 2*a*) until the point in time just before the cut (FIG. 2*h*) (about 25° before the cut) are shown.
Figure 2B:
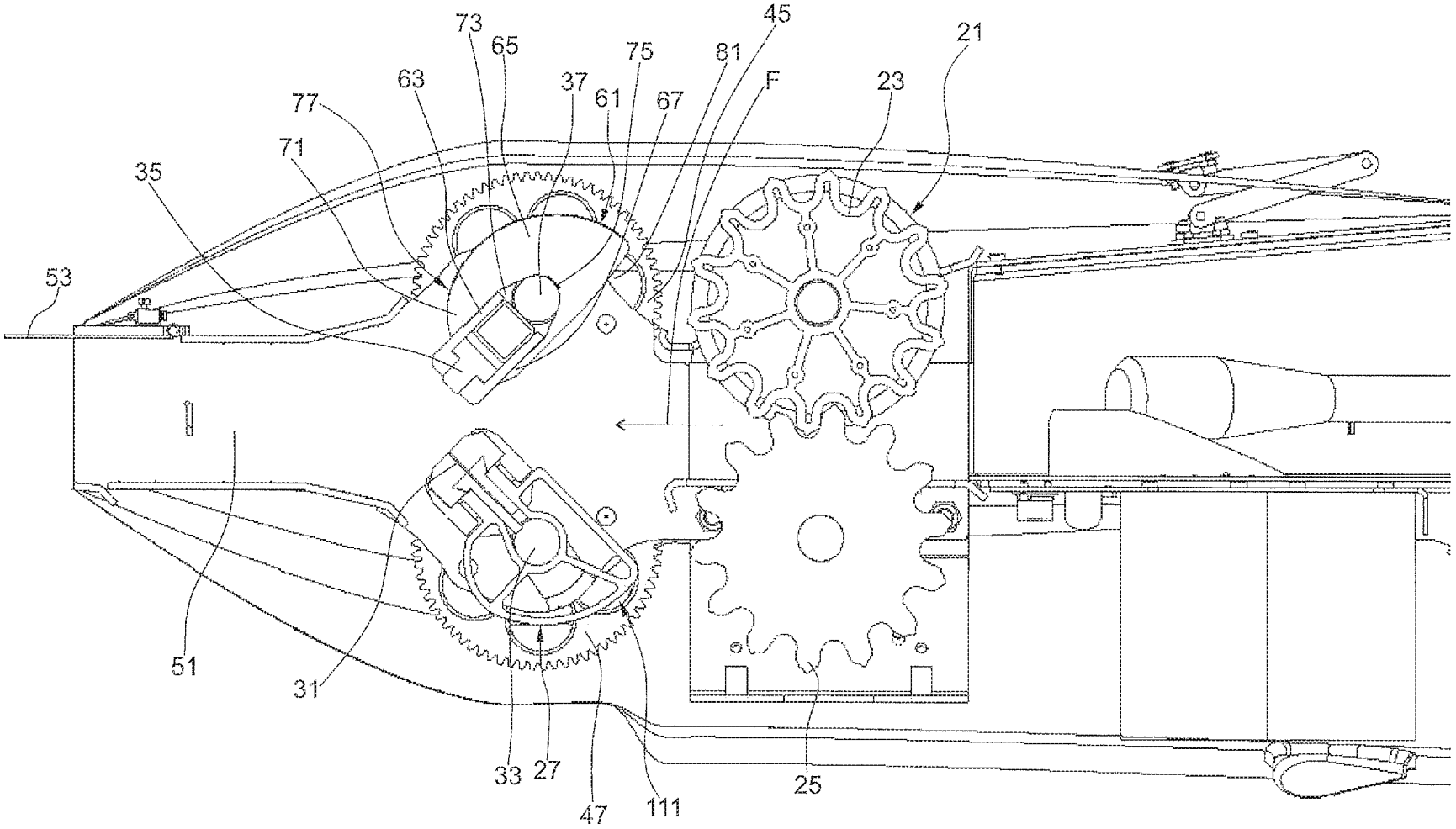
Figure 2C:
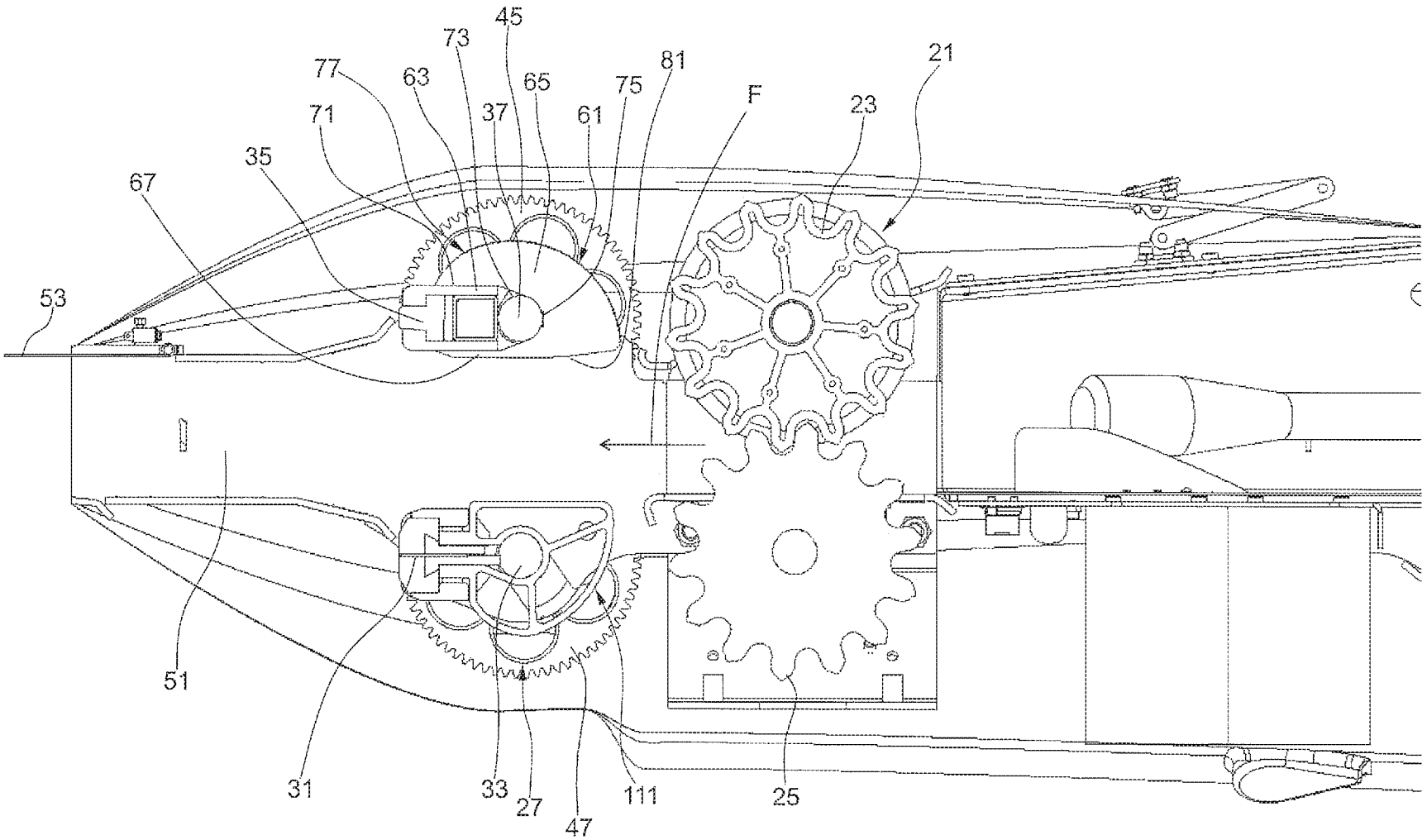
Figure 2D:
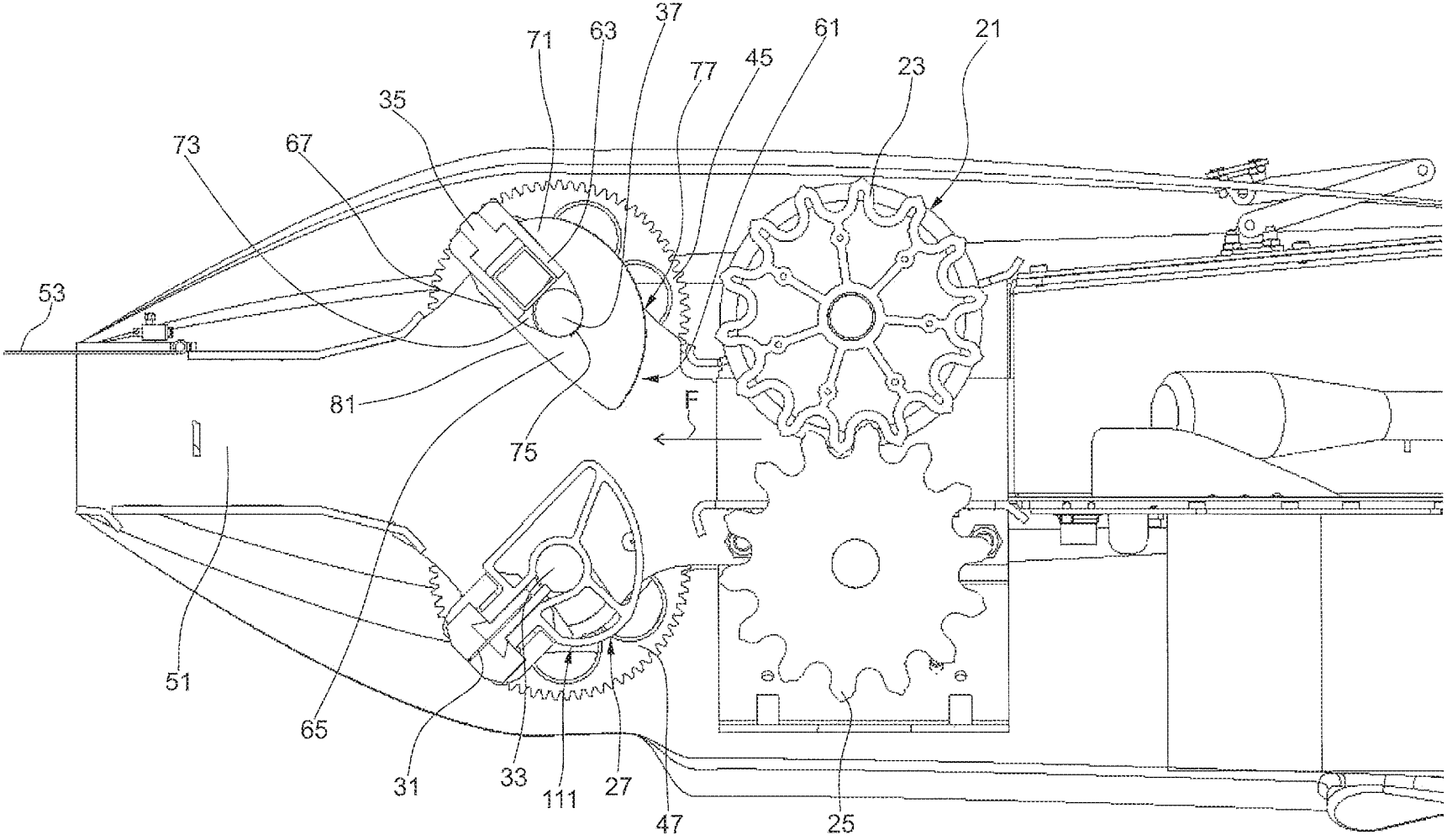
Figure 2E:
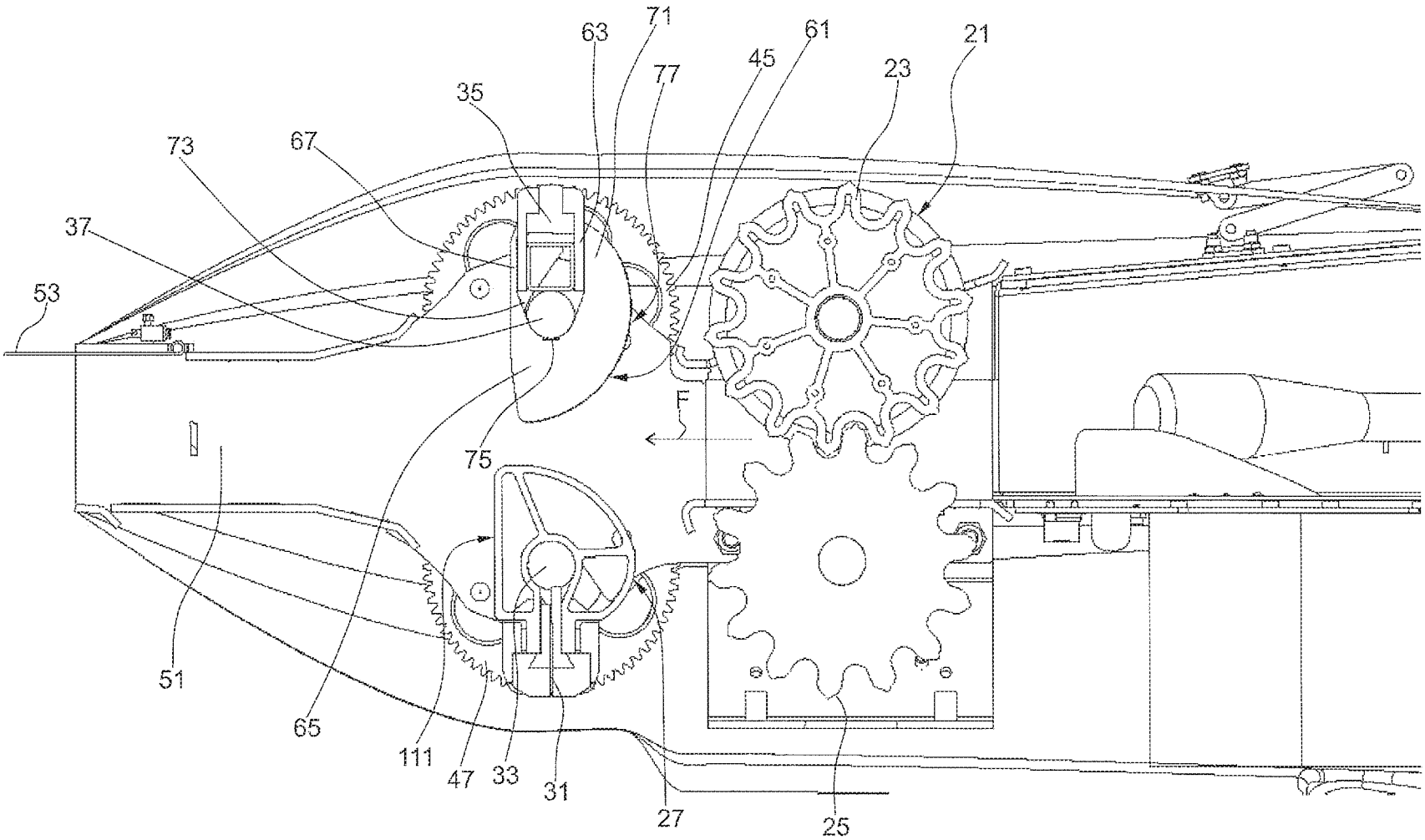
Figure 2F:
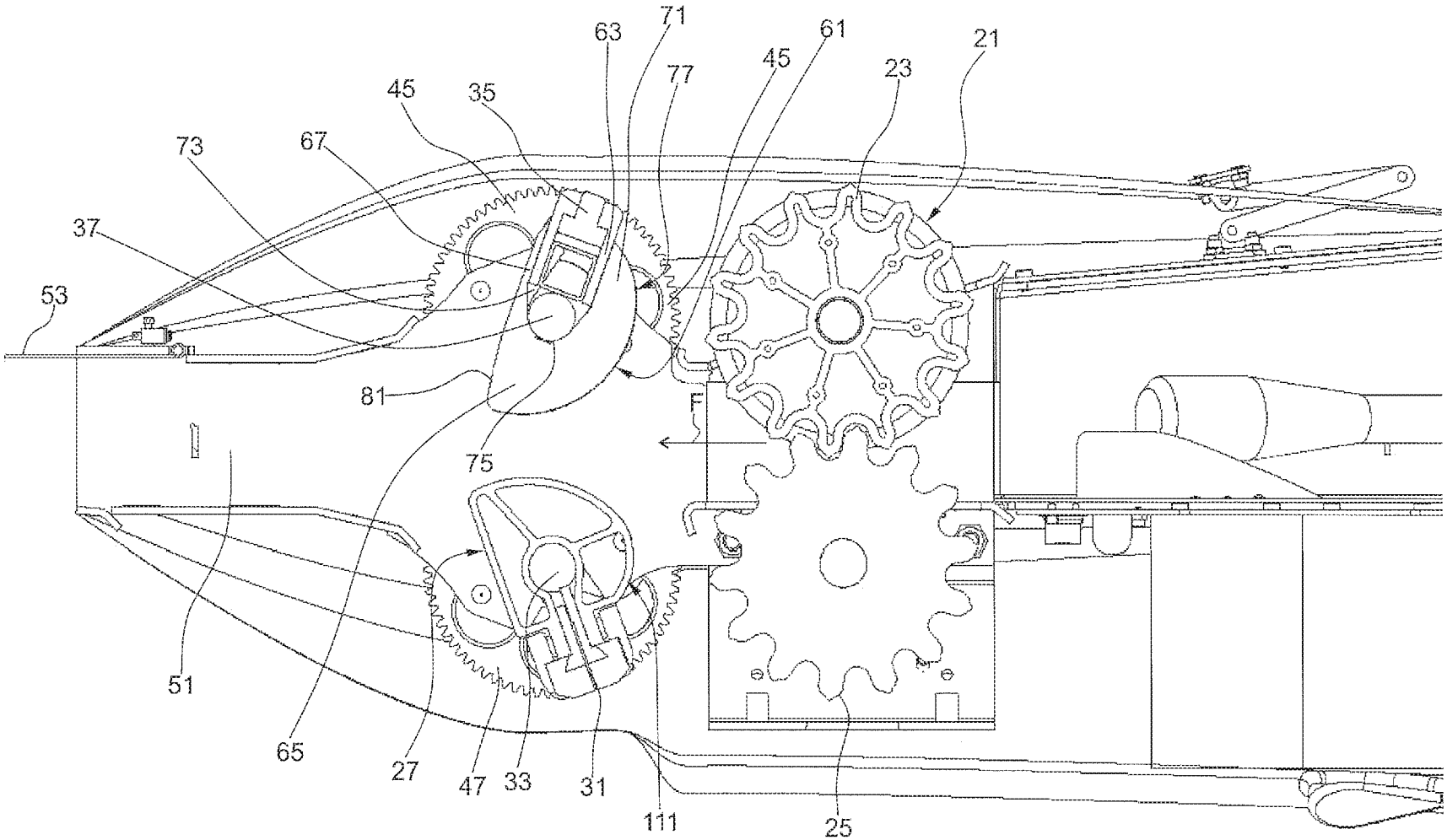
Figure 2G:
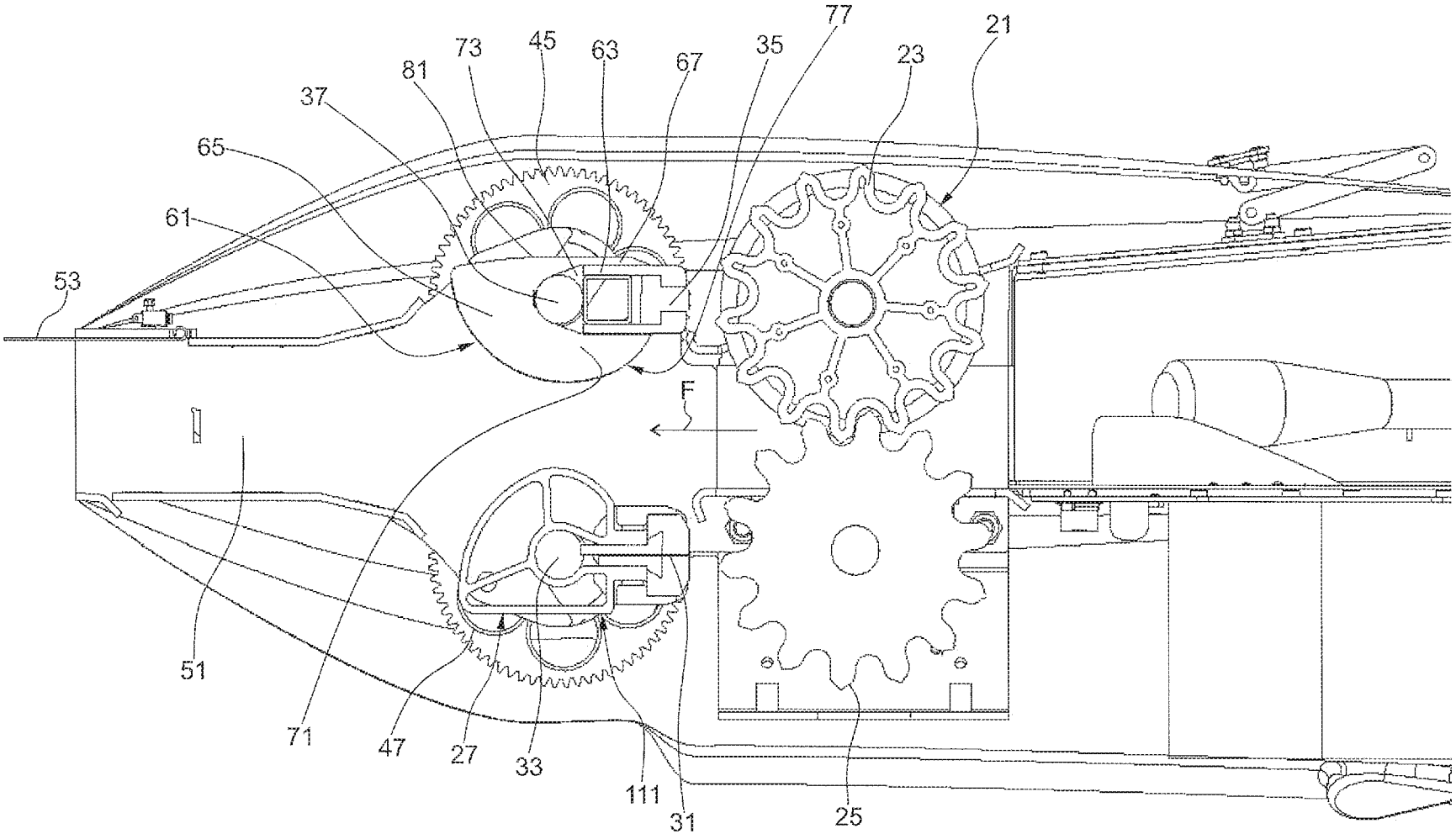
Figure 2H:
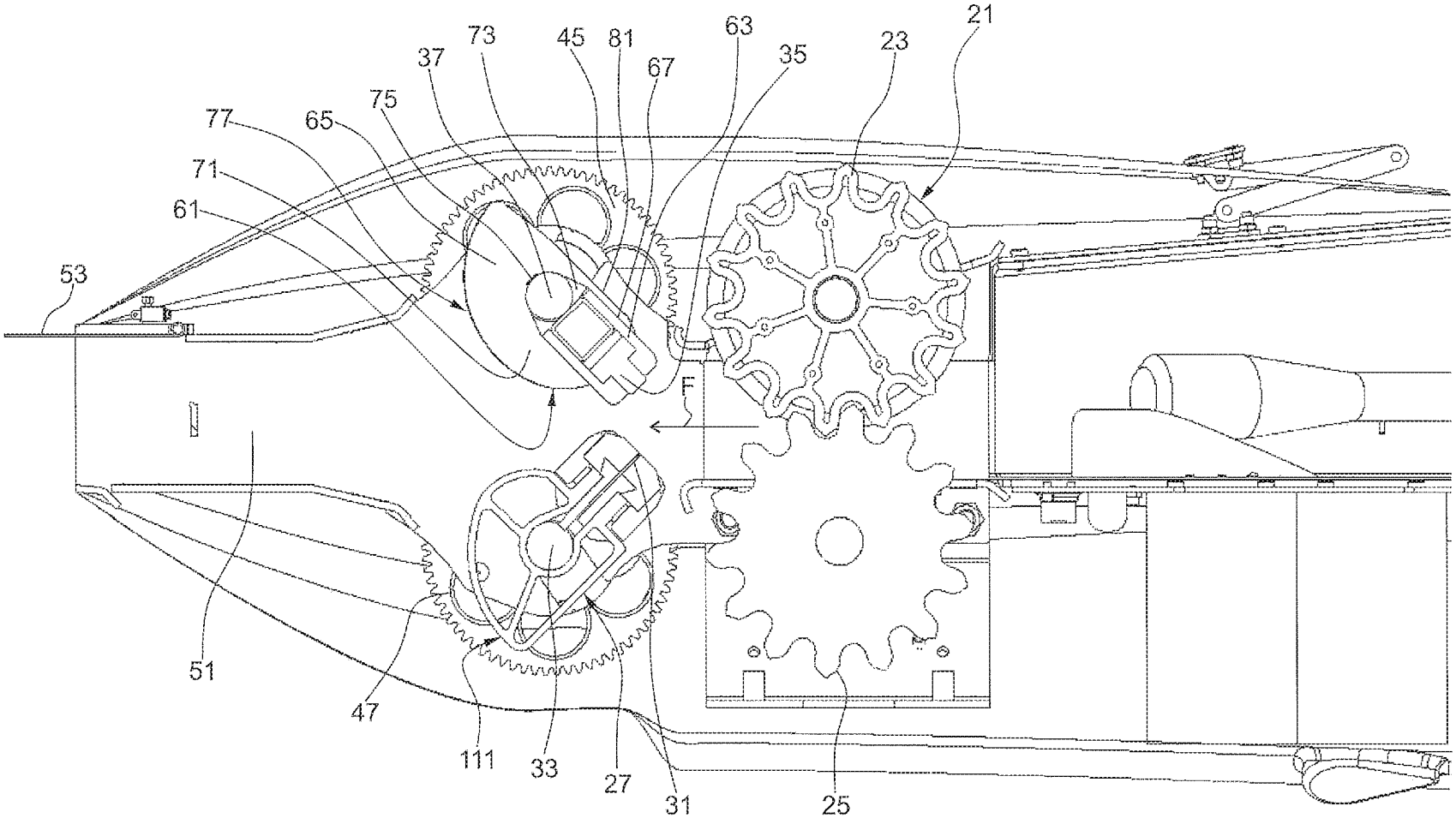
Figure 3A:
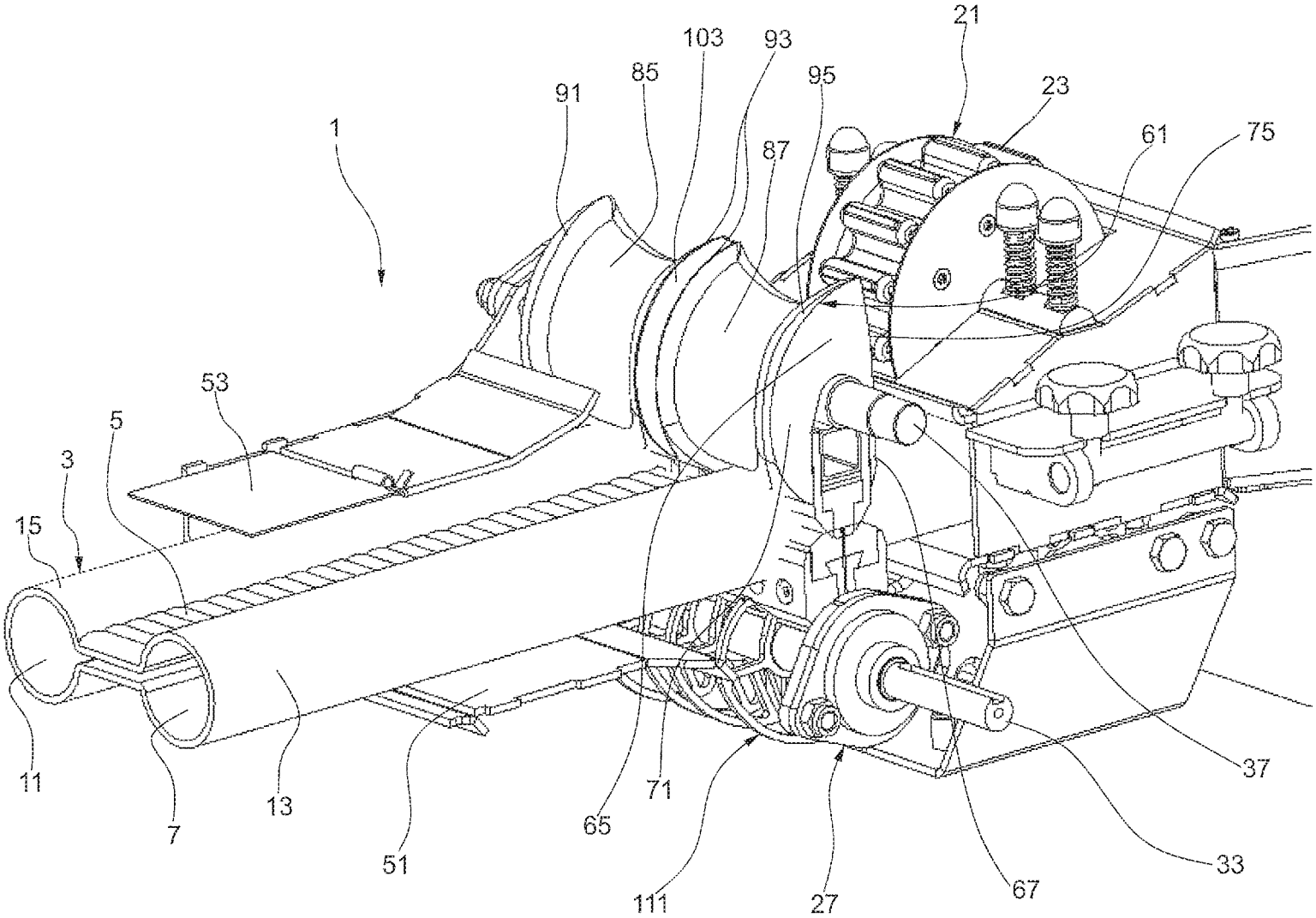
FIG. 3*a-h* is a perspective view of the production apparatus without the housing protection parts or bearings for the respective shafts of the rotation cutter shown in FIG. 1, wherein the different corner positions starting from the cutting process (FIG. 3*a*) until the point in time just before the cut (FIG. 3*h* (25° before the cut))
Figure 3B:
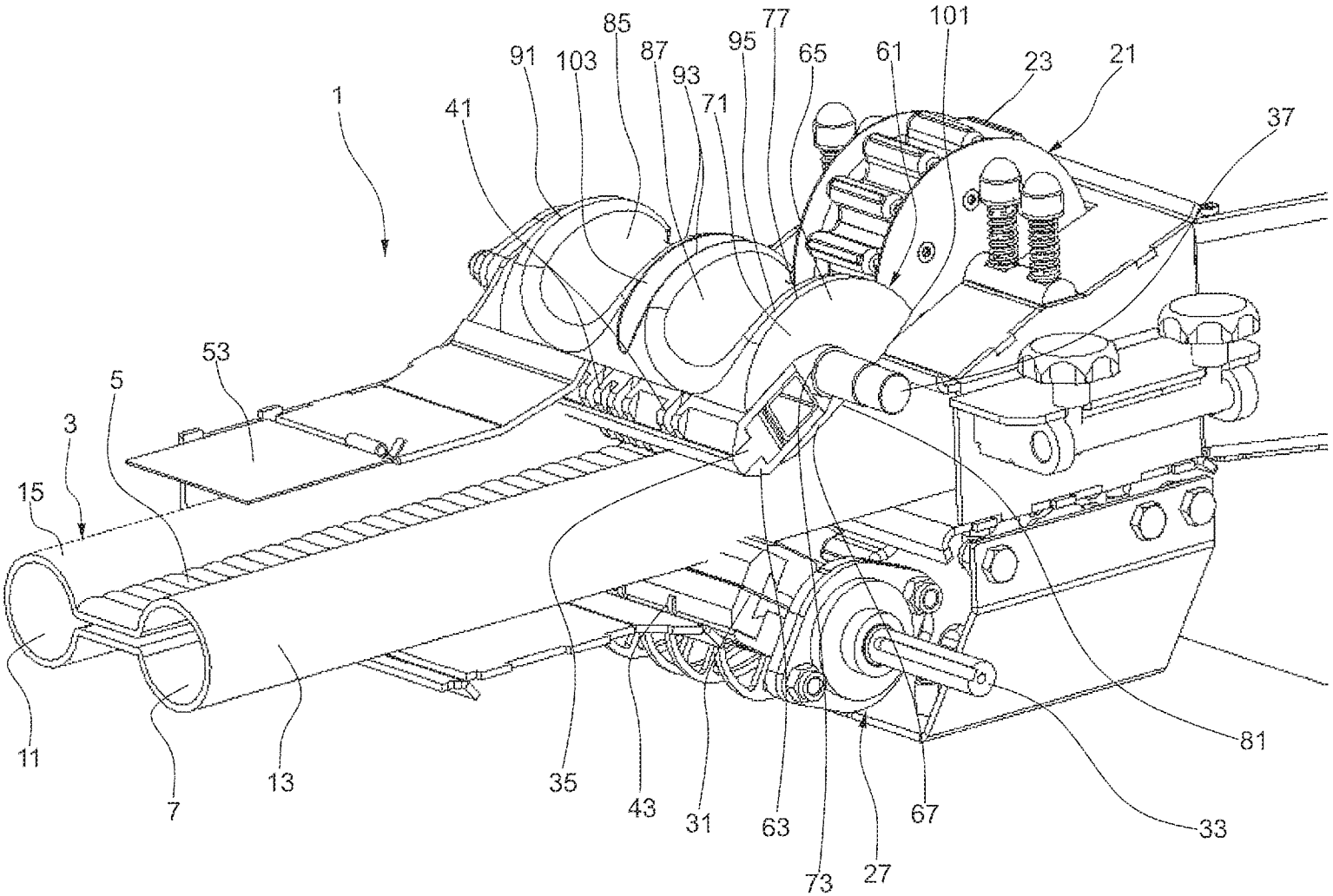
Figure 3C:
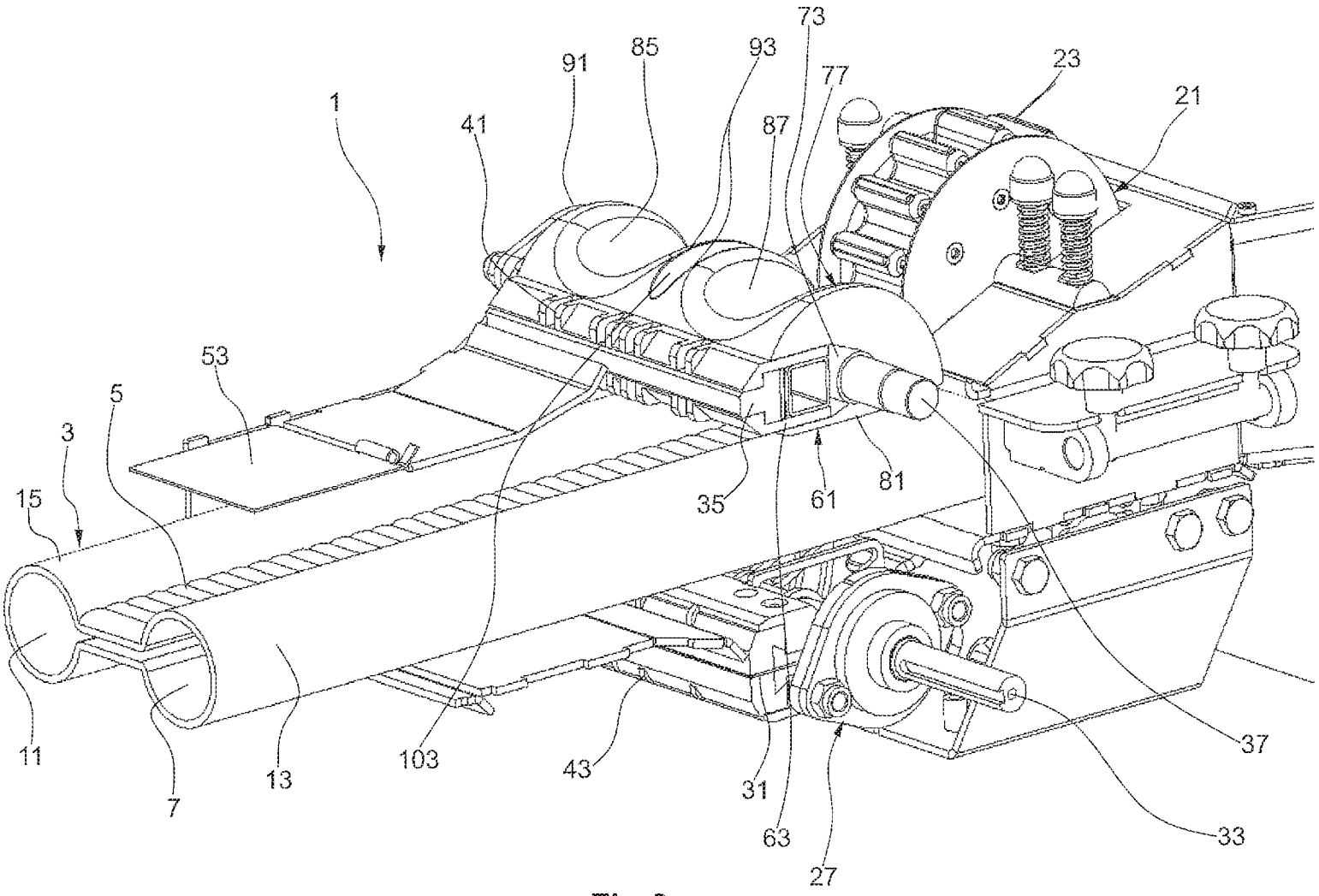
Figure 3D:
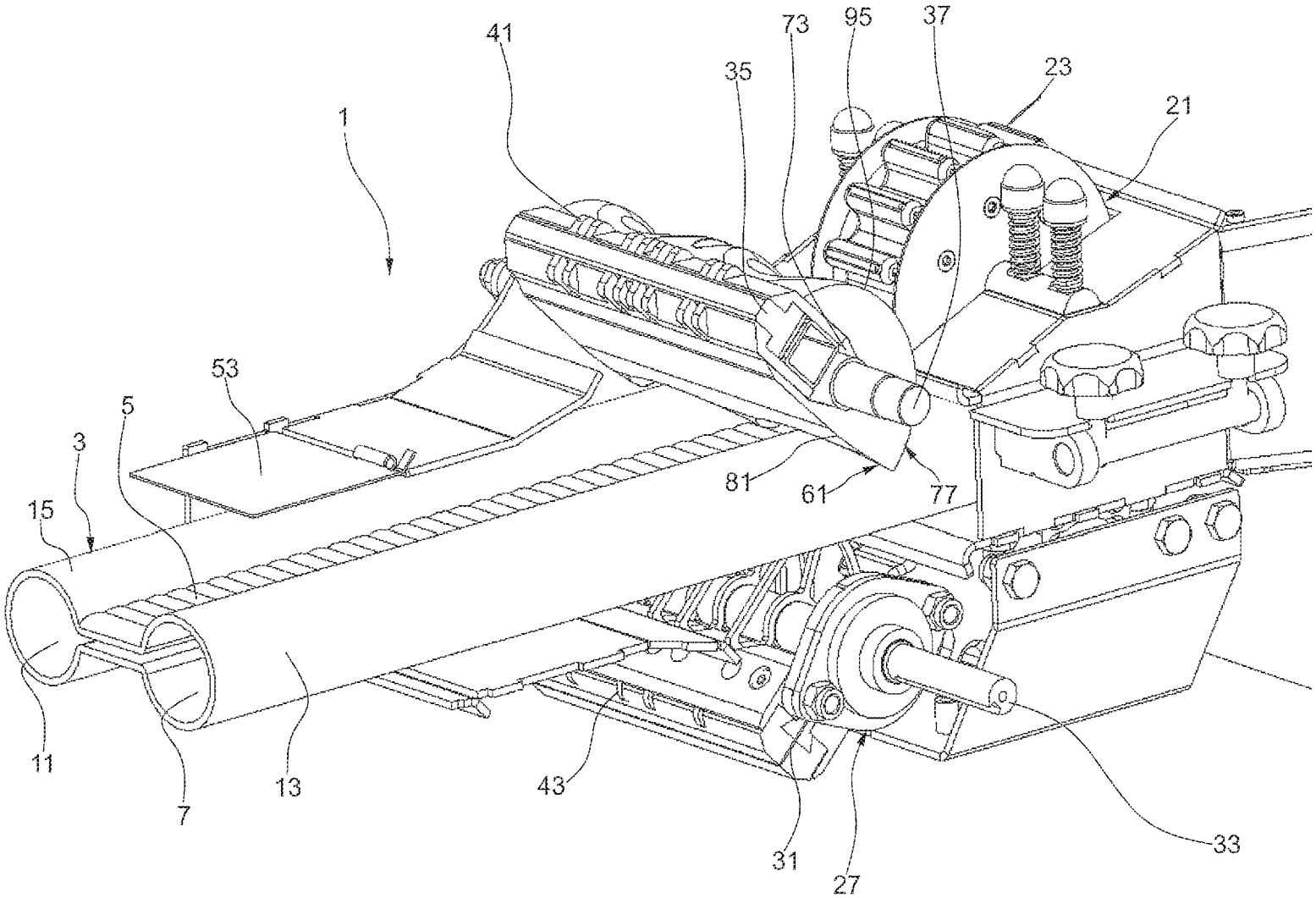
Figure 3E:
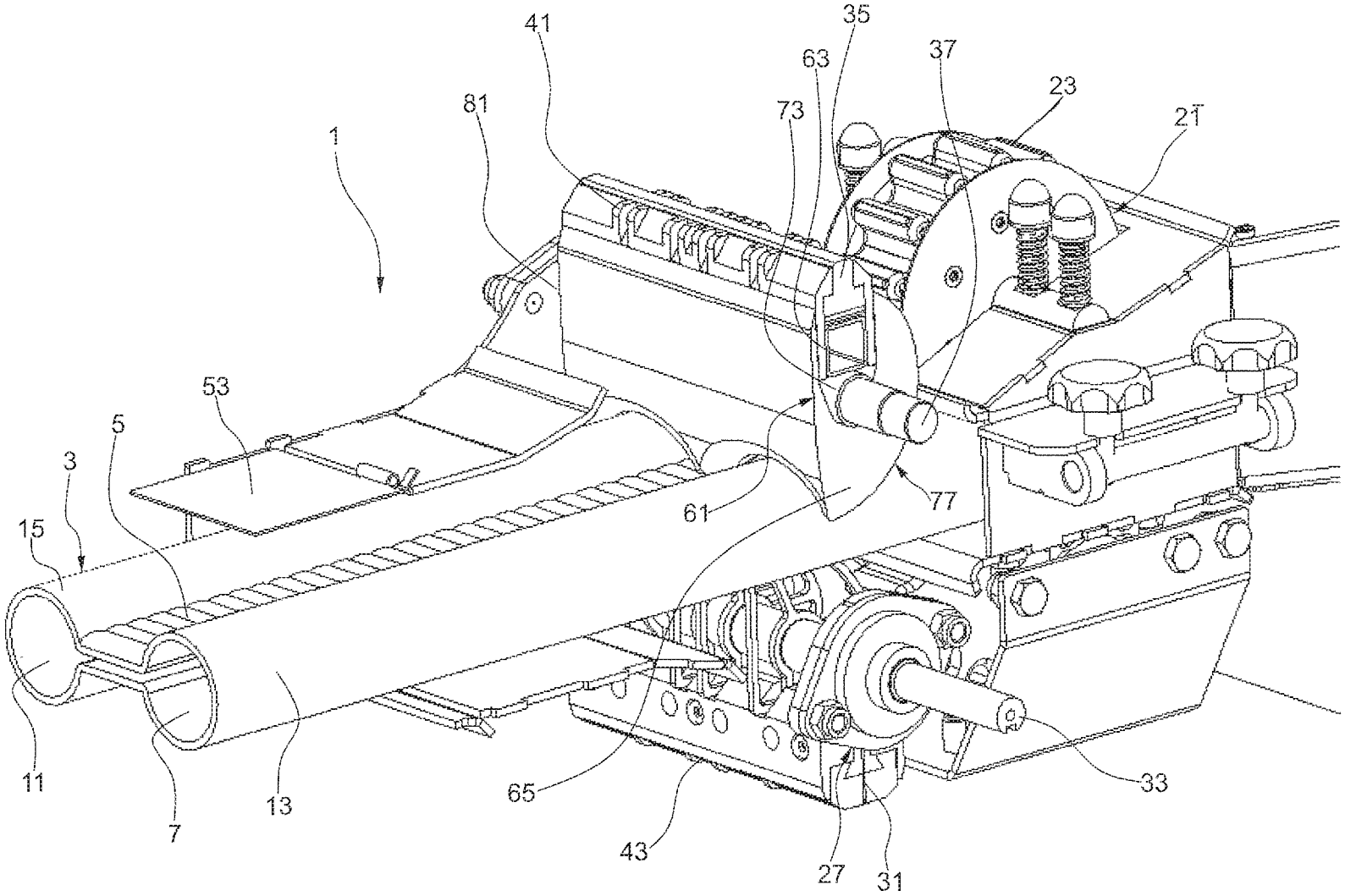
Figure 3F:
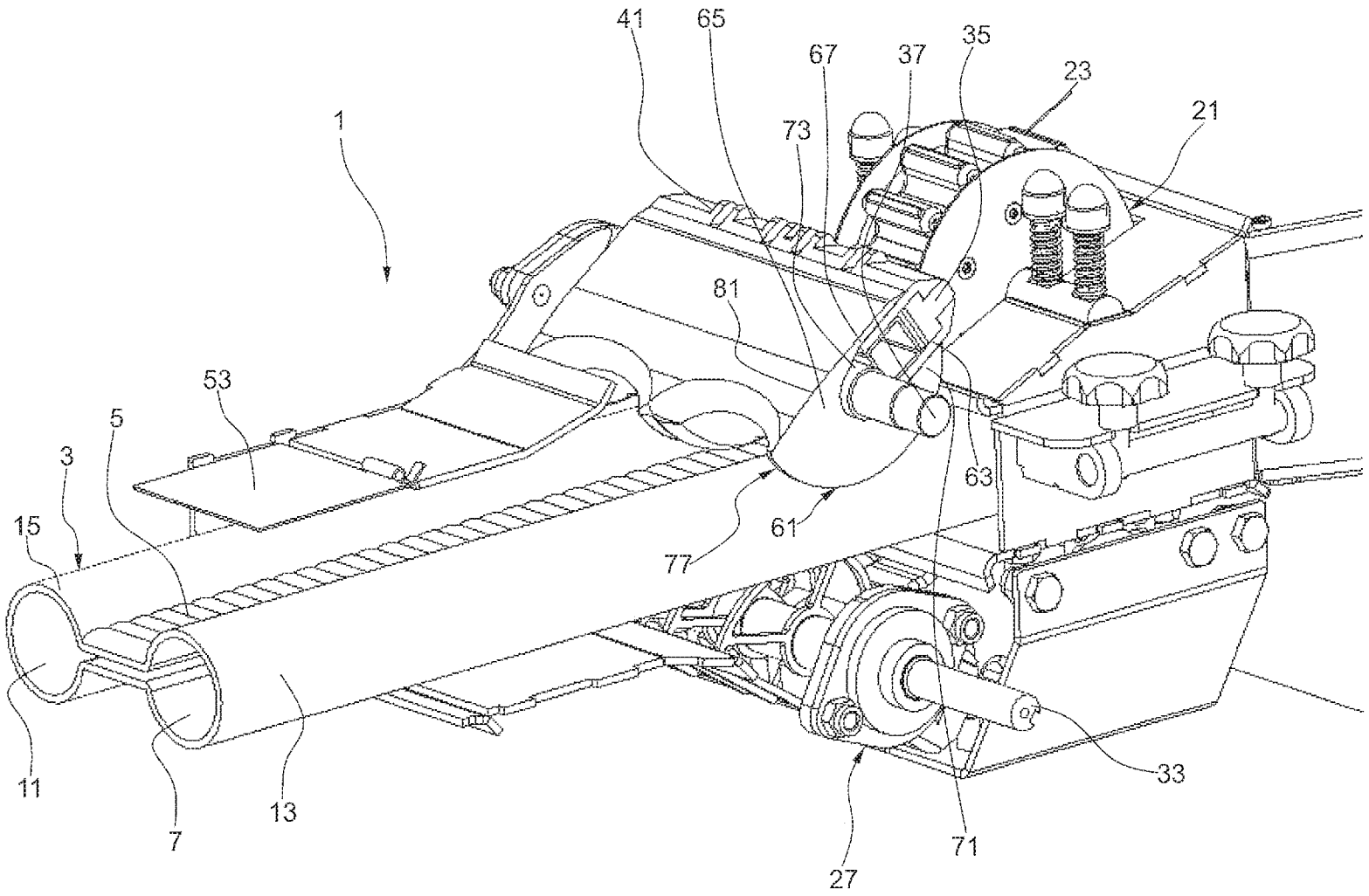
Figure 3G:
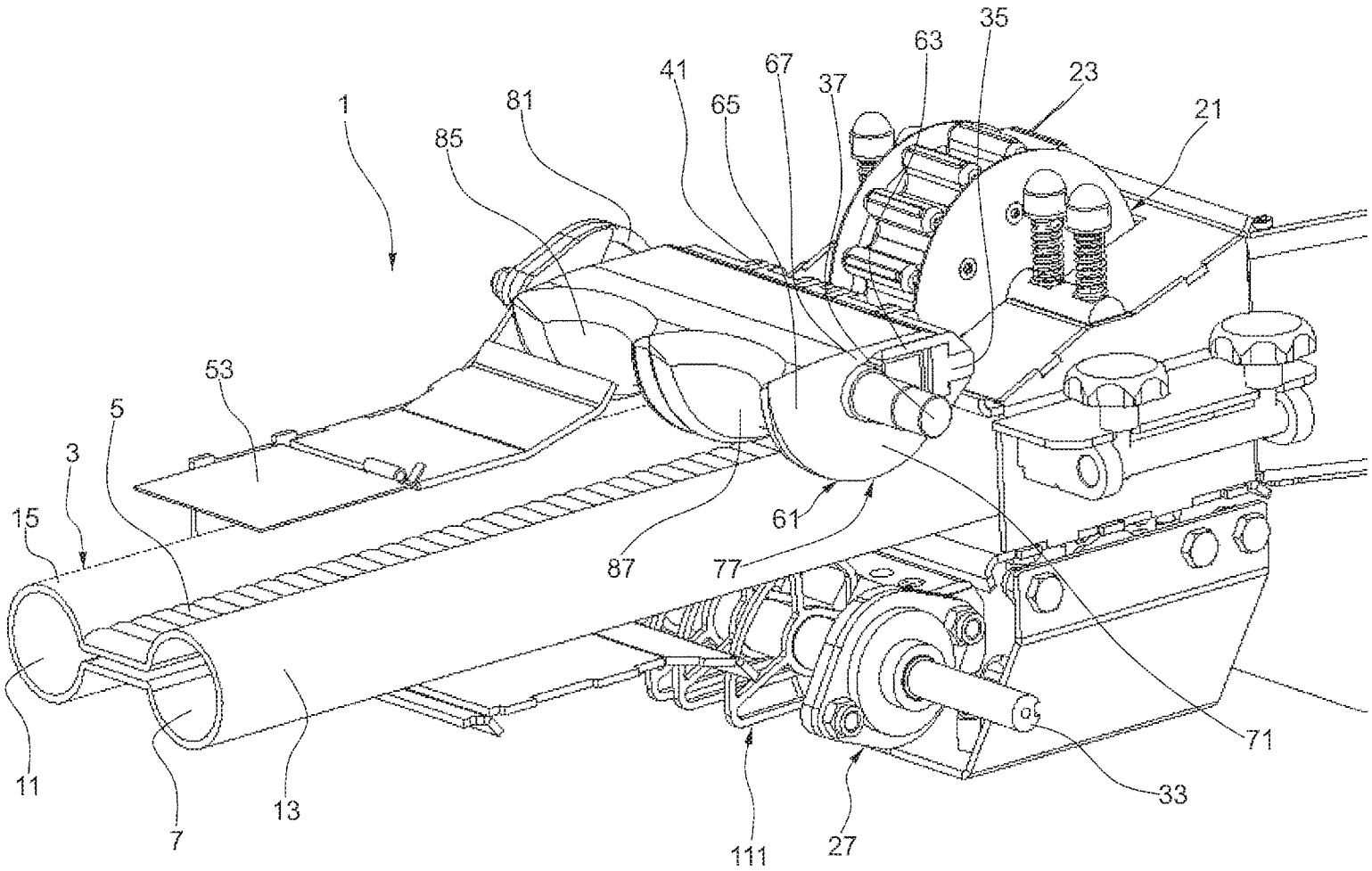
Figure 3H:
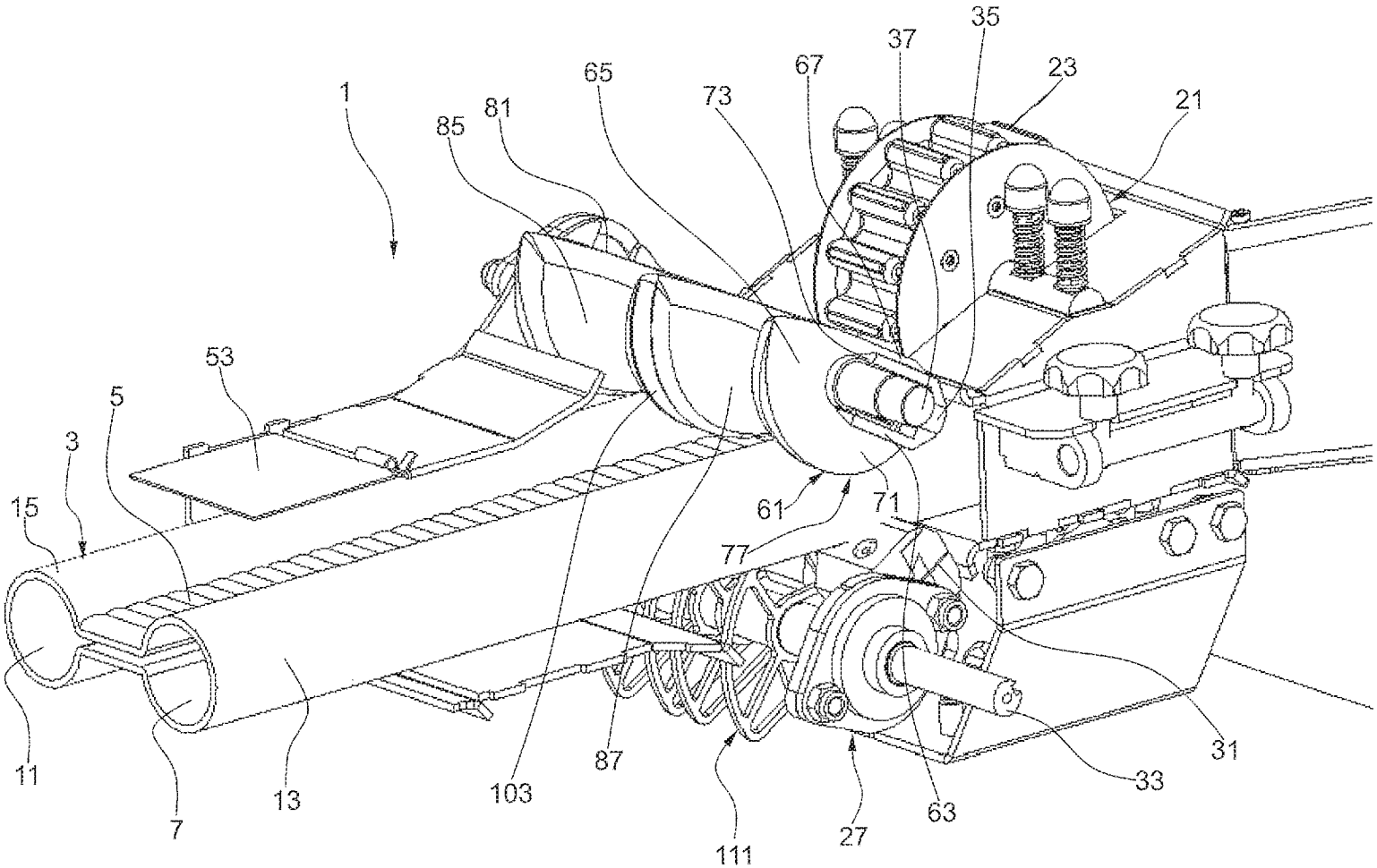

The cushion product is shown in the Figures schematically. It may have no idealized shape but depends on the shapability of the respective paper, a mere principle design of the cushion product being dumbbell-shaped in cross section shown in the Figures. The cushion product 3 according to one embodiment has a central deformation strip 5 being accompanied by two lateral crumple hollow spaces, wherein the cushion properties are mainly formed by the crumple hollow spaces 7 and 11. By the employment of the crumple hollow spaces, the cushion product has a dumbbell shape with the two cushion curvatures 13, 15 on the outside being essential with regard to the specific profiling of the flush set-on element according to the invention later on. Depending on the embodiment of the cushion product 3, one side of the profile of the set-on element can be formed correspondingly.

The apparatus according to the invention has a preforming station being formed by a folding and/or rolling unit (at 17) not further shown here as well as by a deformation unit 21 shown in FIGS. 2, 3. The deformation unit is attributed with the reference numeral 21. The deformation unit 21 has two opposing embossing wheels 23, 25 on which a feed path F is defined from its outlet to the rotation cutter 27. The rotation cutter 27 is arranged following up in the feed direction F having a cutting knife 31 cutting the feed path F in the cutting position (12 o'clock position (see FIG. 2)). The set up of the cutting knife 31, preferably the attachment to the cutting knife shaft 33 and the synchronization with the cutting pad 35 being mounted to a counter shaft 37 opposing the cutting knife shaft. The counter shaft 37 and the cutting knife shaft 33 are at the same height with regard to the feed direction F. In the cutting position, the cutting pad 35 is in a 6 o'clock position as shown in FIG. 2*a*. Further details to the rotation cutter 37 are given in the German patent application DE 10 2012 018 867 A1 being a reference with regard to the disclosure of the rotation cutter 37 as well as the respective imprint station. The same applies to the perforation tool used in an embodiment being formed by the perforation noses 43 and the perforation seat 41. This perforation tool is described in detail in DE 10 2013 015 875 A1 and shall be added here to the disclosing content by reference.

As apparent from FIG. 2, the respective shafts 33, 37 are driven by a pair of teeth wheels 45, 47 in order to assure the synchronization of the cutting pad 35 and the cutting knife 31.

Following the rotation cutter 27 the cutoff preformed paper strip section is arriving at the outlet of the production apparatus via the initially slightly rectangular-shaped feed channel 51, being lockable by a plate 53 in order to inhibit access at the outlet.

As shown from FIGS. 2 and 3, a set-on element 61 is set on the counter shaft 37. The set-on element 61 is glued to the counter shaft 37 and to a holder 63 holding the cutting pad 35.

The set-on element has a honeycomb body fabricated by a 3D printer mold and comprising a base 65 from which two gripping arms, a narrow gripping arm 67 and a stronger gripping arm 71 are extending at the counter shaft 37 and the holder 63. The gripping arms 67, 71 form a longitudinal slot 73, through which the counter shaft 73 is introduced into the set-on element 61 including the holder 63. The free width of the gripping arms 67, 71 of the longitudinal slot 73 is adapted to the holder 63 or the counter shaft 37, respectively, in such a way that a form-fit is formed there. The longitudinal slot formed by the gripping arms 67, 71 has a feature base 75, being formed partly cylinder section-shaped according to a cylinder shape of the counter shaft 37 in order to ensure a safe fit of the set-on element 61 at the counter shaft 37.

As apparent particularly in FIG. 3, the set-on element comprises a cushion product outer profile 77 being formed particularly in the area of the stronger gripping arm 71. Furthermore, the set-on element has a channel outer wall 81 opposing the cushion product outer profile 77 corresponding to the narrow gripping arm 67. The embodiment of the set-on element is shown in detail in the FIGS. 4, 5 and 6.

The plane channel outer wall 81 is essentially flat and has only a slight tendency to inclination approximately at the height of the feature base 75 of the longitudinal slot 73.

The cushion product outer profile 77 is adapted to the in cross-section dumbbell-shaped cushion product 3 and has two profile recesses 85, 87 being delimited in the axial direction X by three radial elevations 91, 93, 95 running in the circumferential direction.

With respect to the longitudinal axis X, the radial distance r of the cushion product outer profile decreases in circumferential course regarding both the radial elevations 91-95 and the profile recesses 85, 87 in a first section, wherein the radial distance r is increasing again after about 90-120° after the first cut, whose profile becomes apparent particularly in FIG. 2.

The radial distance $r_k$ is initially decreasing at the plane channel outer wall 81 and increasing afterwards again.

Figure 4:
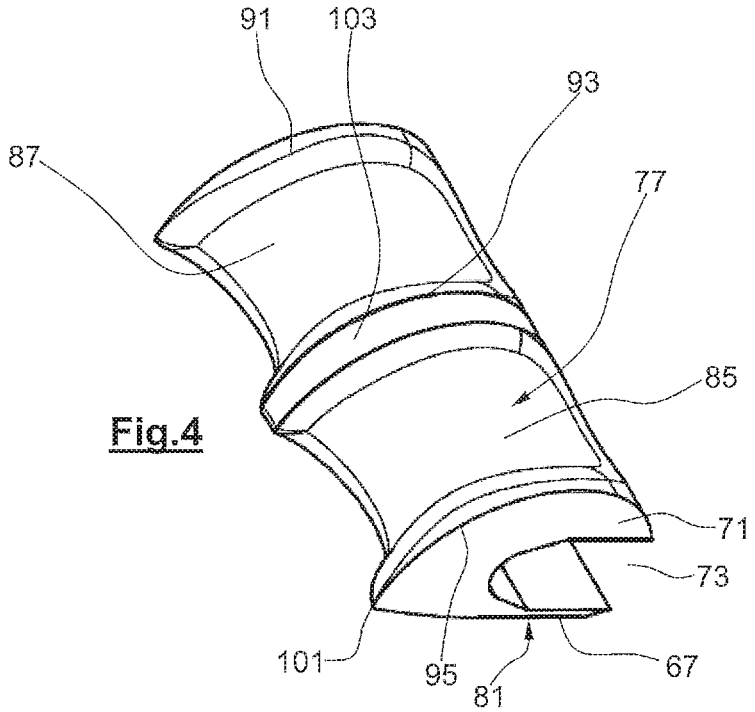
FIG. 4 is a perspective view of the set-on element according to the invention for setting on one of the shafts, namely cutting knife shaft or counter shaft.
Figure 5:
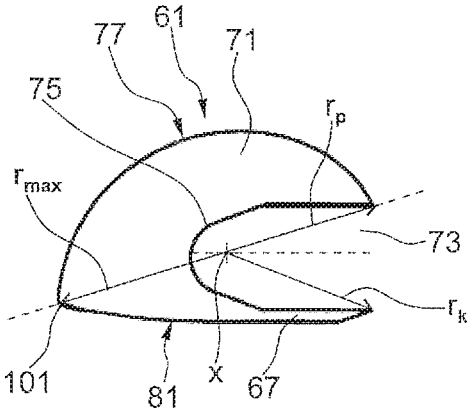
FIG. 5 is a cross-sectional view of set-on element, wherein the cross-sectional line is drawn through the center with a radial elevation.
Figure 6:
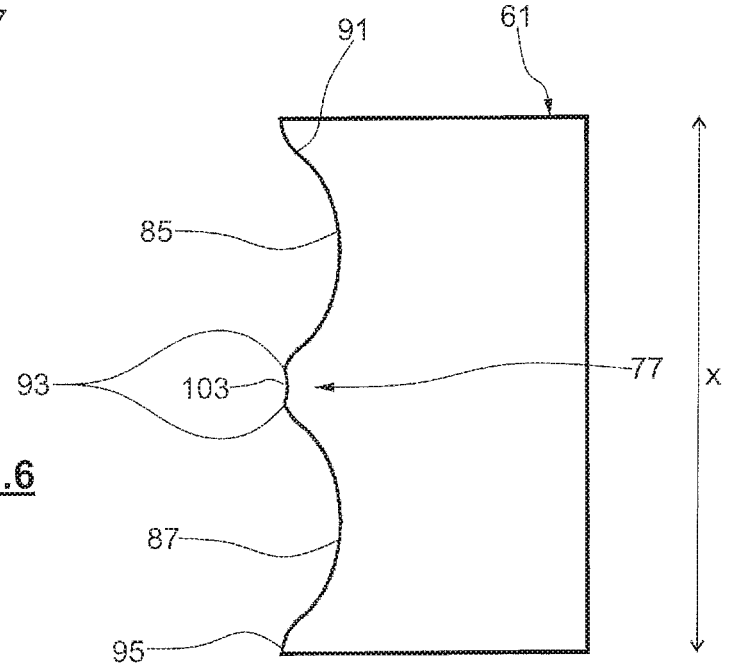
FIG. 6 is a frontal view of the set-on element.

The cushion product outer profile 77 starts abutted to the holder 63 of the cutting pad 35 and merges in a radial top point or top point line 101 having a maximal radial distance $r_{max}$, wherein the radial distance $r_{max}$ is highest at the radial elevations 91-93 becoming particularly apparent in the FIGS. 4, 5 and 6. The area of the radial top point line 101 serves as a feed driver regarding the cut off paper strip section when the cutting pad 35 is brought in a 12 o'clock position, compare FIG. 2*e*. The set-on element with an area of the radial top point line 101 and the flat channel outer wall 81 feeds the cut off paper strip section towards the outlet of the production apparatus 1 in the fashion of a shovel.

The radial top point line 101 is not located on the axis of the cutting knife or the center of the cutting pad, respectively, but rather displaced by about 10-30° compared to a 180° position.

The essential radial elevation 93 comprises a cable recess 103 having for example a radius of 14 mm±3 mm. The circle section-shaped profile recess 85, 87 in cross-section (see FIG. 6) is likewise circle section-shaped and has a radius of 40 to 50 mm. The width in the axial direction X for the set-on element 61 is 50 to 1000 mm, particularly about 100 to 200 mm, preferably between 140 and 160 mm.

As shown in FIGS. 2*f*, 3*f*, 2*g*, 3*g*, 2*h*, 3*h*, the set-on element 61 according to an embodiment being in flush contact with the preformed cushion product 3 on the side of the cushion product outer profile is adapted to the same. By means of the wide cushion product outer profile 77, the cutoff cushion product is guided outwardly from the area of the rotation cutter without squashing the delicate crumple hollow space 7, 11 of the cushion product 3.

Contrary to the working disc 111 being mounted to the cutting knife shaft 33, the flush set-on element can impose no jam barrier for the preformed paper strip section, since the latter can slide along the continuous curvature of the profiling of the set-on element. By that, it can be advantageous to arrange a set-on element 61 also in the area of the cutting knife in order to avoid locking or ripping of the paper strip section by the working discs 111. It was nevertheless shown that by the usage of at least one set-on element 61, a significant improvement of paper jam avoidance can be realized.

The flush set-on element is for example facilitated by being manufactured from a plastic piece, BAL being preferred. It was found out that a precise fabrication by a 3d printer is advantageous.

The attributes disclosed in the previous description, the Figures and the claims can used for the realization of different embodiments both separately and in arbitrary combination.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description. While various embodiments of the invention have been described, it will be apparent to those of ordinary skill in the art that many more embodiments and implementations are possible within the scope of the invention. Accordingly, the invention is not to be restricted except in light of the attached claims and their equivalents.

LIST OF REFERENCE NUMERALS

1 production apparatus
3 cushion product
5 deformation strip
7, 11 crumple hollow space

13, 15 cushion curvature
21 deformation station/deformation unit
23, 25 embossing wheel
27 rotation cutter
31 cutting knife
33 cutting knife shaft
35 cutting pad
37 counter shaft
41 perforation seat
43 perforation noses
45, 47 teeth wheel/gear
51 feed channel
53 plate
61 set-on element
63 holder
65 base
67, 71 gripping arm
73 longitudinal slot
75 feature base
77 cushion product outer profile
81 channel outer wall
85, 87 profile recesses
91, 93, 95 radial elevations
101 radial top point line
103 cable recesses
111 working discs
R radial distance
F feed path/feed direction
X axial direction

I claim:

1. An apparatus for the production of a three-dimensional packaging product including a cushion product from a single- or multi-layer paper strip, the apparatus comprising:

a preforming station that is deforming the paper strip to the three-dimensional packaging product with at least one crumple hollow space extending in strip direction;

a rotation cutter following the preforming station in the feed direction of the paper strip, that is cutting off a preformed paper strip to a desired length of the packaging product from a preformed paper strip;

a cutting shaft, on which a blade of the rotation cutter is mounted;

a counter shaft, on which a cutting pad is mounted, in which the blade is engaging during the cutting process; and a set-on element mounted to the cutting shaft or the counter shaft for enlarging a flushing radial extension of the cutting shaft or the counter shaft, and forming a flush profile channel wall section, whose flush profile course is extending in the axial direction of the shaft at least half of the width of the preformed paper strip section.

2. The apparatus according to claim 1, wherein the set-on element has a longitudinal slot, via which the cutting shaft or the counter shaft is introduced into the set-on element in the radial direction, wherein the longitudinal slot merges into a feature base being formed in sections form-complementary to the cutting shaft or the counter shaft or on which multiple recesses are formed for receiving a compound material, or the set-on element comprising two gripping arms extending in the axial direction for forming the longitudinal slots, each of the gripping arms gripping both, the cutting shaft or the counter shaft and a holder for the blade or for the cutting pad in forming a form-fit, wherein the respective holder can protrude beyond the radial extension of the gripping arms.

3. The apparatus according to claim 2, wherein the set-on element comprises a flush that is curved in cross-section in the axial direction and in the circumferential direction cushion product outer profile being arranged upstream in revolution circumferential direction of the cutting shaft or the counter shaft on the opposite side of a holder for the blade or the cutting pad of the rotation cutter or having at least one profile recess at the axial position of the at least one crumple hollow space of the packaging product so that the profile recess is form-fitted to a cushion curvature formed by the crumple hollow space.

4. The apparatus according to claim 3, wherein the at least one profile recess is delimited by radial elevations in the axial direction, so that the radial elevations are holding the cushion curvature against an axial evasion along the perimeter of the cushion product outer profile, wherein a radial distance of the profile course of the cushion product outer profile is continuously decreasing along an axial direction of the at least one profile recess or the radial elevation, of the entire cushion product outer profile, starting from the holder for the blade or the cutting pad of the rotation cutter in the circumferential direction, in the revolution direction of the cutting shaft or the counter shaft, being mounted to the cutting shaft or the counter shaft, according to a first circumferential section and continuously increasing according to a second circumferential section following the first circumferential direction in the revolution direction or merging into a radial top point whose radial extension is largest with respect to the set-on element or being arranged in a circumferential distance of 160° to 225° of the blade or the cutting pad.

5. The apparatus according to claim 3, wherein a radial distance of the gripping arms is smaller compared to a radial top point in the area of the radial elevations being arranged diametrically opposed to the radial distance of the gripping arms.

6. The apparatus according to claim 5, wherein the gripping arms are in a circumferential distance of about 125° to 225° or being larger in the area of the at least one profile recess at their lowest position.

7. The apparatus according to claim 3, wherein the at least one profile recess is formed circle section-shaped along an axial cross-section with a radius of more than 20 mm, wherein at least one radial elevation comprises a central radial elevation that is formed circumferentiating with a concave recess whose curvature is smaller than the at least one profile recess or being formed circular-shaped with a radius of smaller than 20 mm and larger than 5 mm.

8. The apparatus according to claim 1, wherein the set-on element comprises a flush, plane outer wall in cross-section in the axial direction and in the circumferential direction, which is being positioned downstream on the opposite side of a holder for a blade or cutting pad in the revolution circumferential direction of the cutting shaft or the counter shaft, wherein the plane channel outer wall extending flat from the holder of the blade or the cutting pad being mounted to the cutting shaft or the counter shaft towards a radial top point, whose radial extension is largest with respect to the set-on element or being arranged in a circumferential distance of 125° to 190° from the blade or the cutting pad.

9. The apparatus according to claim 8, wherein the plane channel outer wall transitions continuously into the cushion product outer profile, at the circumferential position of the radial top point of the cushion product outer profile.

10. The apparatus according to claim 8, wherein the flush body of the set-on element has an axial extension between 50 mm and 1000 mm.

11. The apparatus according to claim 1, wherein the set-on element is molded by additive manufacturing of a flush body piece or the flush set-on body being rotationally unsymmetric to the longitudinal axis of the respective cutting shaft or counter shaft and axially symmetric to an axis parallel to the feed direction.

12. The apparatus according to claim 11, wherein the set-on element being at least in an axial direction and circumferential direction a flush hollow body, whose outer side being in sections profiled and plane or that same having a honeycomb structure at the inner side.

13. The apparatus according to claim 11, wherein the additive manufacturing comprises a three dimensional ("3D") printer technology.

14. The apparatus according to claim 11, wherein the flush body piece comprises a plastic piece made from polylactide ("PLA").

15. The apparatus according to claim 12, wherein the honeycomb structure at the inner side comprises quadratic combs of a same shape.

* * * * *